US005361519A

United States Patent [19]

Ciula et al.

[11] Patent Number: 5,361,519

[45] Date of Patent: Nov. 8, 1994

[54] CONTROL PAD FOR A SNOWPLOW

[75] Inventors: James C. Ciula, Mentor; Charles J. Smick, Jr., North Ridgeville, both of Ohio

[73] Assignee: The Louis Berkman Company, Cleveland, Ohio

[21] Appl. No.: 15,431

[22] Filed: Feb. 9, 1993

[51] Int. Cl.[5] ..... E01H 5/04

[52] U.S. Cl. ..... 37/234; 37/236

[58] Field of Search ..... 37/236, 235, 234, 196, 37/279, 266, 382, 902, 906, 907; 248/205.2; 24/306, 304

[56] References Cited

U.S. PATENT DOCUMENTS

| | | | |
|---|---|---|---|
| 2,868,489 | 1/1959 | Calcut | 24/304 |
| 3,706,144 | 12/1972 | Miceli . | |
| 4,320,589 | 3/1982 | Pelazza | 37/236 X |
| 4,439,939 | 4/1984 | Blau | 37/235 X |
| 4,807,375 | 2/1989 | Iraci | 37/236 |
| 4,831,752 | 5/1989 | Clevenger | 37/234 |
| 4,999,935 | 3/1991 | Simi et al. | 37/234 X |
| 5,058,295 | 10/1991 | Holland | 37/236 X |
| 5,192,042 | 3/1993 | Wotring et al. | 243/205.2 |
| 5,265,356 | 11/1993 | Winter | 37/236 X |
| 5,285,588 | 2/1994 | Niemela et al. | 37/234 |

*Primary Examiner*—Randolph A. Reese
*Assistant Examiner*—Spencer Warnick
*Attorney, Agent, or Firm*—Vickers, Daniels & Young

[57] ABSTRACT

A control device for controlling the position of a snowplow mounted on the front of a vehicle is disposed in the cab of the vehicle and is selectively mountable in any one of a plurality of locations in the cab to facilitate access to the control device in accordance with the preference of the vehicle and snowplow operator. The control device includes a housing supporting manually operable pushbutton switches which control the selectable plow positions. The housing is provided with one component of a two component separable fastening arrangement, the second component of which is mounted in the cab in one or more of a plurality of selectable positions, such as on the dashboard, armrest, console, gearshift lever or clothing worn by the vehicle operator, whereby the control device can be positioned in a location most convenient to the operator. The control device includes switches controlling solenoid actuated valves by which the position of the snowplow blade is adjusted and includes circuitry operable when the blade is lowered to contact ground to bypass the corresponding switch such that the blade is maintained in a floating mode.

17 Claims, 6 Drawing Sheets

CONTROL PAD FOR A SNOWPLOW

BACKGROUND OF THE INVENTION

The present invention relates to the art of snowplows for automotive vehicles and controls therefor and, more particularly, to the manually operable control device located in the cab of the vehicle and by which the position of the plow blade is controlled.

The present invention finds particular utility in conjunction with a snowplow and control system of the character disclosed in U.S. Pat. No. 3,706,144 to Miceli which is owned by the assignee of the present invention and the disclosure of which is hereby incorporated herein by reference. Accordingly, the invention will be disclosed and described in detail herein in conjunction with a plow and control system according to the latter patent. At the same time, however, it will be appreciated that the invention is applicable to other snowplow and control system arrangements.

In a snowplow and control system arrangement of the character disclosed in the Miceli patent, the snowplow blade is mounted on the front of a car, small truck, or the like, together with hydraulic cylinders by which the blade is elevated and lowered relative to the vehicle and the underlying ground and by which the blade is angled to the left or right relative to the vehicle and ground. The plow and control system further includes solenoid operated valves by which the flow of hydraulic fluid to and from the cylinders is controlled to achieve the various positioning functions. Selective positioning of the plow blade through control of the solenoid valves and an electric motor driven hydraulic pump in the system is achieved through a control device mounted in the cab of the vehicle such as on the dashboard thereof for operation by the vehicle operator, whereby only an electrical cord of sheathed conductors extends from the cab of the vehicle to the operating components of the system. In the Miceli patent, the control device includes a pair of pivotal operating switch levers which serve to control the electrical system and, in turn, the hydraulic system of the plow. Each lever has a neutral or hold position to which the lever has to be manually returned, and one of the levers is pivotal relative to the hold position to selectively achieve raising and lowering of the blade while the other lever is pivotal from its hold position to selectively achieve left or right angling of the blade.

Heretofore, the control device has been mounted in the cab of the vehicle in a location fixed relative thereto, generally at the time of installation of the system. When mounted, the electrical cord leading from the device to the solenoid valves and pump extends under the dashboard of the vehicle and through the fire wall. The control device is generally mounted on the dashboard so as to minimize the length of cord exposed in the cab. However, the control device is often permanently mounted on a console of the vehicle between the front seats, whereby the cord runs across the floor of the vehicle to the fire wall.

Permanent mounting of the control device either on the dashboard or console minimizes or undesirably limits convenience and efficiency with respect to the vehicle operator's control of both the vehicle and the snowplow during a snowplowing operation. In this respect, it will be appreciated that the vehicle operator must steer the vehicle with one hand and manipulate the components on the control device with the other to adjust the position of the plow blade during a snowplowing operation. Depending on the make of the vehicle and the physical size of the operator, dashboard mounting may require the operator to lean forward in the driver's seat to manipulate the control device components, and such body motion or movement can detract from the operator's efficiency in controlling steering of the vehicle and manipulation of the floor pedals. Moreover, a given snowplow vehicle may be driven by several operators each having different physical characteristics, and this too can lead to inconvenience and discomfort for the operator in driving the vehicle and manipulating the snowplow control components during a snowplowing operation. For example, if the control device is mounted on the dashboard to the right of the steering wheel of the vehicle, or on the console, and the vehicle operator is left handed, and not particularly ambidextrous, manipulation of the control device components with the operator's right hand may be awkward as well as difficult for the operator. It will be appreciated, therefore, that the mounting of the control device in a fixed location on the dashboard, console or elsewhere in the vehicle cab area is extremely limiting with respect to convenience of the operator and, in turn, the latter's efficiency in operating the vehicle and snowplow. This can lead to operator fatigue and, more importantly, the potential danger of operating the vehicle with less than a desirable degree of control thereof.

Yet another problem exists with respect to the potential inadvertent and unintended displacement of the snowplow blade during non-snowplow operation of the vehicle in, for example, moving from one snowplow operating location to another. More particularly in this respect, the control device is connected to the vehicle battery through the vehicle ignition system, whereby the control device and thus the electrical components in the system are in an operable mode whenever the vehicle ignition switch is turned on. Thus, for example, if the snowplow is in an elevated position and the vehicle is being driven in a non-snowplowing operation, unintentional or accidental contact with a control component on the control device can result in undesirable movement of the plow blade relative to the vehicle and the underlying roadway. The potential for damaging the snowplow unit and/or the vehicle and/or injuring the vehicle operator will be appreciated simply by imagining what would happen if the plow blade was lowered to engage the underlying roadway while the vehicle was being operated at a high rate of speed, such lowering being possible by inadvertent actuation of the down component on the control device.

SUMMARY OF THE INVENTION

In accordance with the present invention, a snowplow blade position controlling device is provided by which the foregoing and other disadvantages of such devices heretofore available are advantageously minimized or avoided. More particularly in this respect, a blade positioning control device in accordance with the present invention is advantageously adapted to be quickly and selectively mounted in any one of a plurality of different locations in the vehicle cab, thus to optimize convenience with respect to the vehicle operator's use thereof during a snowplowing operation and, accordingly, the latter's efficiency with respect to operation of the vehicle and snowplow unit. In this respect, for example, a given operator can selectively mount the control device in any one of a plurality of locations on the vehicle dashboard, on an armrest adjacent the driver's seat, on the vehicle console between the front seats of the vehicle, on the vehicle gearshift lever, or on clothing worn by the operator, to name a few of the many possibilities. Further in this respect, the control device and vehicle have cooperable components for releasably supporting the control device in such selective positions, such components being provided for example by slidably interengaging bracket components, cooperable magnet and magnetic sheet material components, or the hook-and-loop fastener components commonly known as a VELCRO ® fastener. One of such pair of components is mounted on the control device and the other, or a plurality of the latter, are mounted in the cab at a selected location or locations therein. Advantageously, one such location can be on the dashboard of the vehicle as both a storage and use location for the control device while another location can, for example, be on the console between the front seats of the vehicle or on an armrest. When either of the latter locations are used by an operator during a snowplowing operation, the use of the dashboard location for storing the controller during non-snowplowing use of the vehicle advantageously enables the cord to be stored under the dashboard. Any excess cord can be merely bundled and stored. The selectivity with respect to the possible locations of the control device for operator use during a snowplowing operation also advantageously allows for meeting the preference of a number of different individual operators of the vehicle having different needs with respect to feeling comfortable and thus relaxed in conjunction with the dual functions of operating the vehicle and the snowplow unit virtually at the same time. Furthermore, the control device and mounting arrangements economically provide the desired versatility with respect to mounting selection.

In accordance with another aspect of the invention, the control device is provided with a kill switch for disconnecting the electrical components of the snowplow unit from the power supply independent of the vehicle ignition switch. Thus, when the vehicle is being operated in a non-snowplowing mode, the control device can be deactivated through the kill switch to positively preclude any displacement of the plow blade relative to the vehicle during non-snowplow use of the latter.

In accordance with yet another aspect of the invention, the electrical circuit of the plow blade positioning system includes an arrangement for placing the plow blade in a floating mode when the blade is lowered to engage the underlying ground or roadway. More particularly in this respect, the ground engaging position of the blade is sensed and, in response thereto, preferably with a time delay, the hydraulic line between the plow blade cylinder and hydraulic fluid supply is maintained open in accordance with known practice so that there is a free flow capability of hydraulic fluid between the blade cylinder and supply in response to up and down bouncing movement of the blade during a snowplowing operation.

It is accordingly an outstanding object of the present invention to provide improvements in connection with a control device mounted in the cab of a vehicle for positionally controlling a snowplow blade mounted on the front end of the vehicle.

Another object is the provision of a control device of the foregoing character and mounting arrangements therefor which optimize a vehicle operator's convenience with respect to operating the control device to achieve blade positioning.

Yet another object is the provision of a control device of the foregoing character and mounting arrangements therefor which provide operator selectivity with respect to positioning the control device in the cab area in a location most suitable to the operator.

A further object is the provision of a control device of the foregoing character and mounting arrangements therefor which allow the operator to quickly and selectively change the location of the control device in the cab either prior to or during a snowplowing operation.

Still a further object is the provision of a control device of the foregoing character and mounting arrangements therefor comprised of readily separable fastener components one of which is mounted on the control device and a plurality of the other of which are mounted at different locations in the vehicle cab.

Still a further object of the invention is the provision of a control device of the foregoing character having a wiring cord for connecting the position controlling components thereof with electrically operated component parts of the snowplow unit through the vehicle battery and ignition switch and having a self-contained switch for disconnecting the control components from the vehicle battery independent of the ignition switch.

Yet another object is the provision of an electrically and hydraulically operated snowplow unit with a control device in the cab of the vehicle for positionally controlling the snowplow blade and which includes a bypass switching arrangement responsive to sensing of the plow blade engaging ground to maintain the plow blade in a floating mode independent of the control component by which the blade is lowered.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
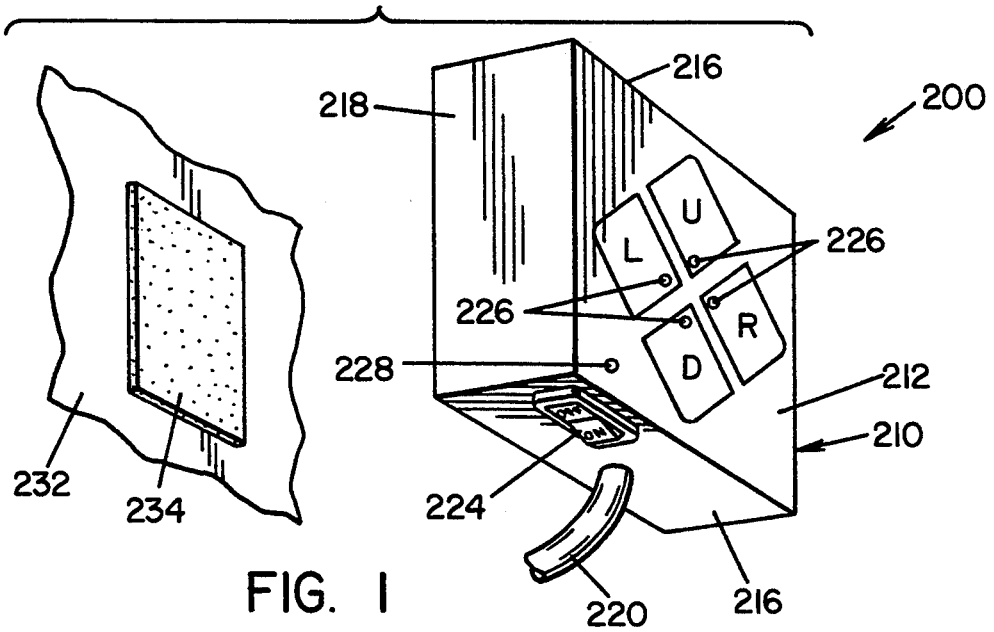
FIG. 1 is a perspective view of a control device in accordance with the present invention and a mounting component therefor on a portion of the vehicle dashboard.
Figure 2:
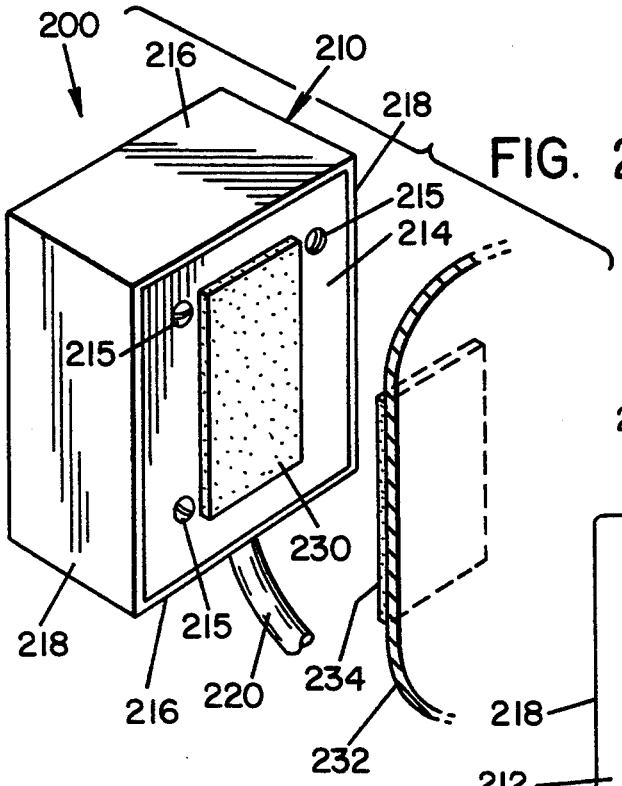
FIG. 2 is a perspective view, in reverse, of the control device and mounting component in FIG. 1 and showing a mounting component on the backside of the control device.
Figure 3:
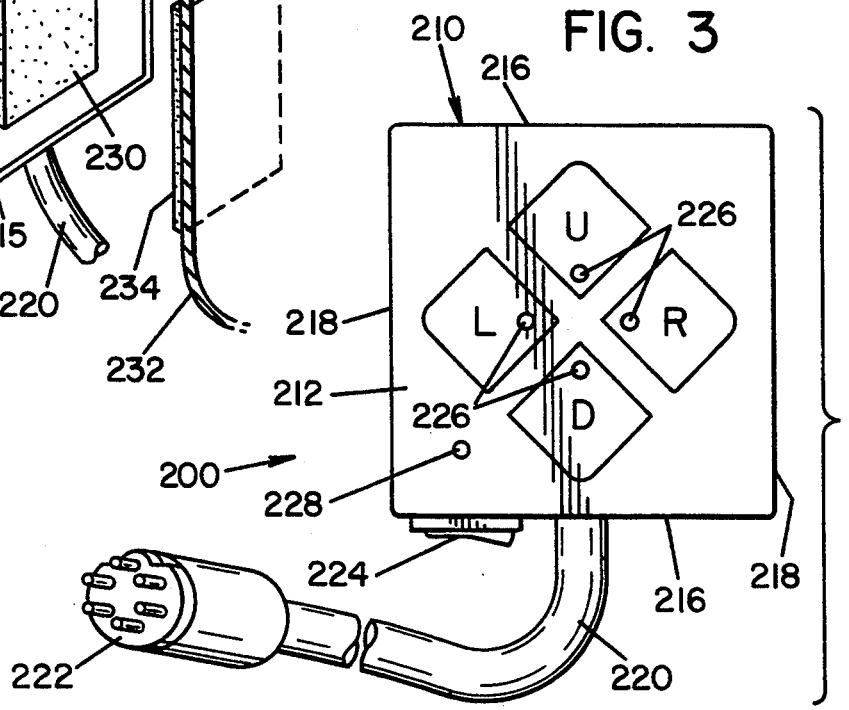
FIG. 3 is a plan view of the control device.

Referring now in greater detail to the drawings wherein the showings are for the purpose of illustrating preferred embodiments of the invention only, and not for the purpose of limiting the invention, FIGS. 1–3 illustrate a control device 200 which, as explained more fully hereinafter, is operable to control the positioning movements of a snowplow blade through the electric and hydraulic system disclosed in the aforementioned patent to Miceli incorporated herein by reference. Control device 200 includes a housing 210 of suitable plastic or sheet metal comprised of a front or top wall 212, a rear or bottom wall 214, and opposed pairs of side walls 216 and 218 between walls 212 and 214. Control device 200 houses four pushbutton switches, not shown, each of which has a corresponding actuator pad exposed through an opening therefor in wall 212 of housing 210. More particularly, as shown in FIGS. 1 and 3, the four actuating pads are provided with letter indicia U, D, L and R which respectively indicate the plow blade positioning function controlled by the corresponding switch, namely up (U), down (D), left (L) and right (R). Each of the switches is actuated by depressing the corresponding actuator pad inwardly of housing 210, and each of the actuator pads is biased outwardly of wall 212 to a normal or hold position in which the corresponding switch is deactivated. Control device 200 is adapted to be connected to the solenoid valves and pump motor of the snowplow unit through an electrical cord 220 which, in the embodiment illustrated, has a male connector plug 222 on the free end thereof for matingly connecting with a female plug on the end of a cord connected to the electrical components of the snowplow unit.

As will become apparent hereinafter, control device 200 is connected to the snowplow unit through the vehicle battery and ignition switch, whereby power for operating the snowplow unit is available upon starting the vehicle and thus closing the ignition switch. As described more fully hereinafter, one of the side walls 216 of housing 210 is provided with a kill switch 224 having "on" and "off" positions by which control device 200 can be disconnected from the vehicle battery independent of the vehicle ignition switch. Preferably, each of the switch actuator pads is provided with a corresponding indicator light 226, which lights are illuminated at all times when switch 224 is "on" so as to indicate the latter to the vehicle operator as well as to illuminate the actuator pads to optimize the operator's visual reading of the indicia thereon. Also for the purpose to be set forth more fully hereinafter, wall 212 of housing 210 is provided with an indicator lamp 228 which, when illuminated, indicates to the operator that the plow blade is engaging ground in a float mode.

Figure 4A:
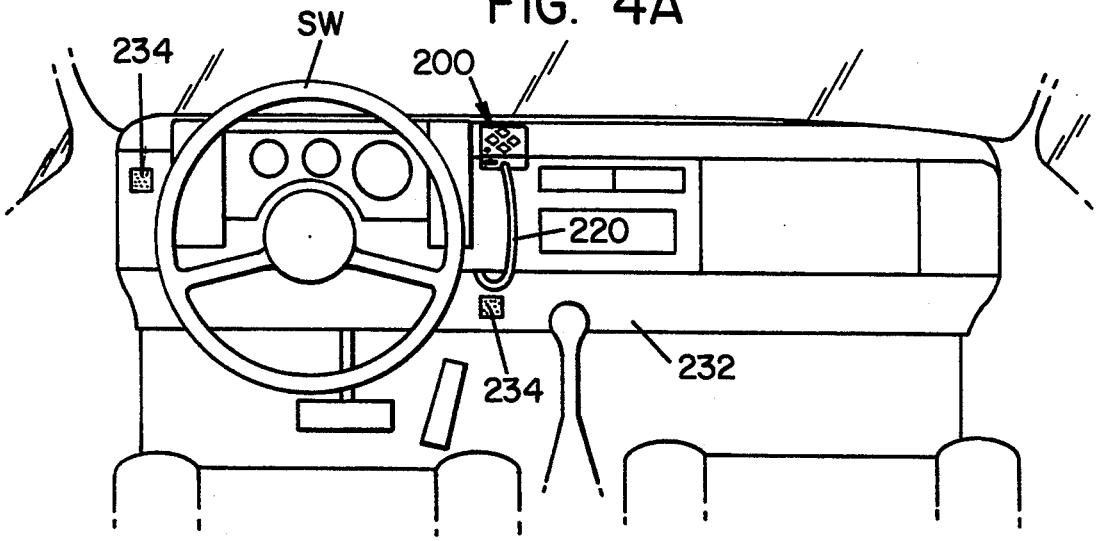
FIGS. 4A–4E illustrate a portion of the cab of a vehicle and a plurality of control device mounting components at various locations therein.
Figure 4B:
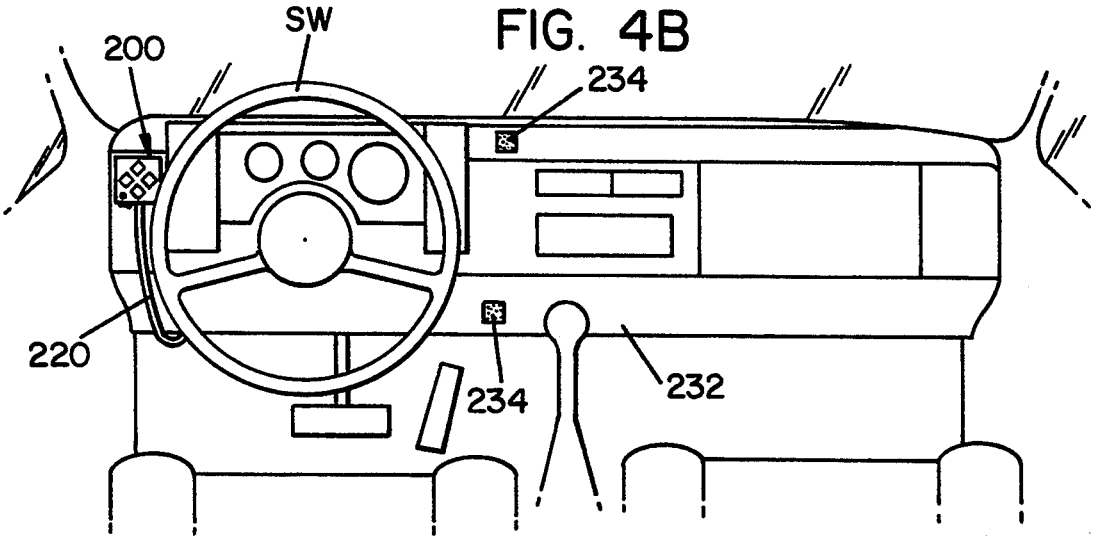
Figure 4C:
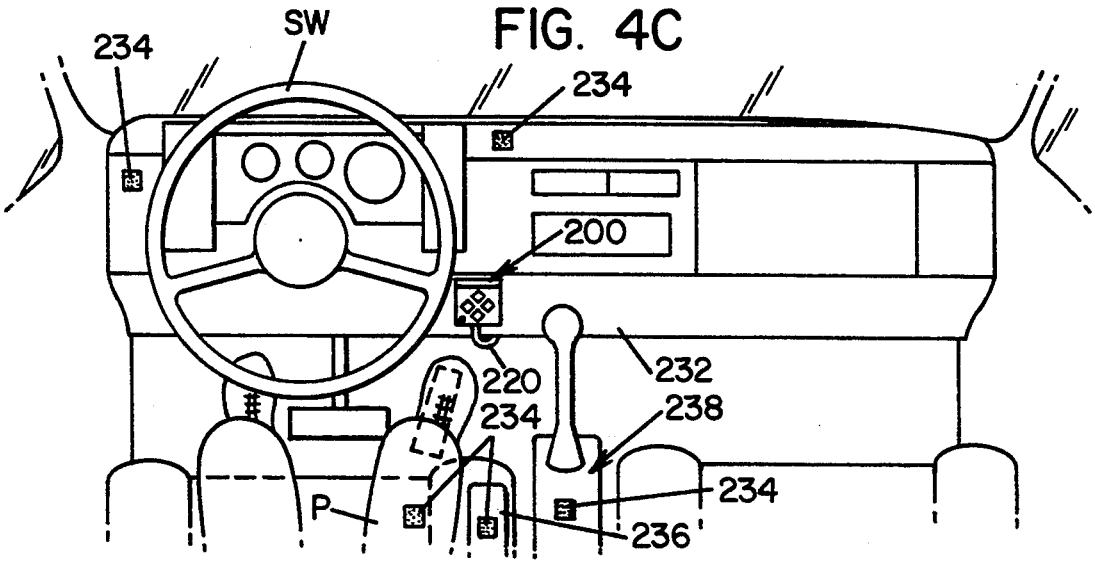
Figure 4D:
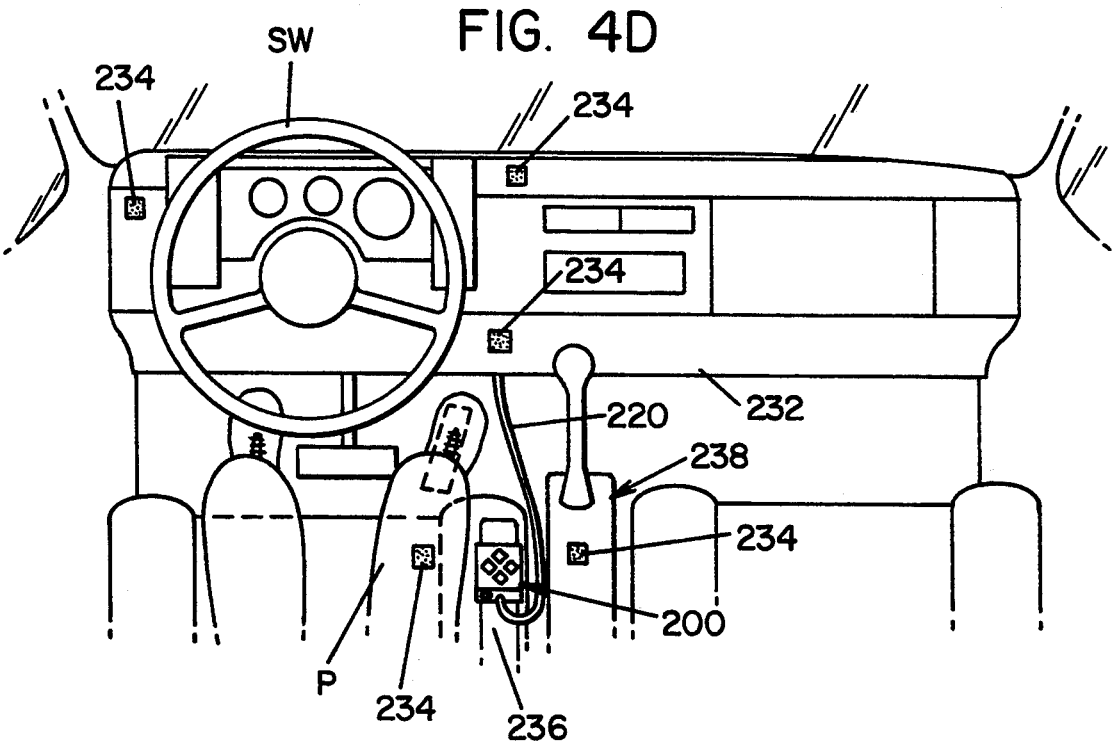
Figure 4E:
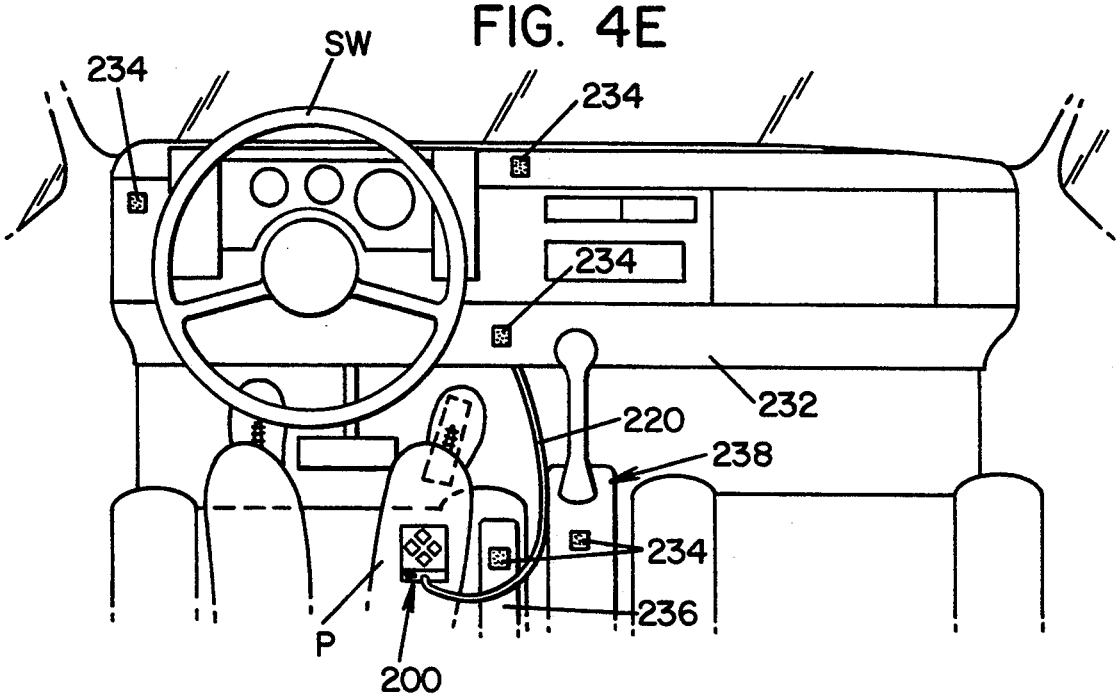
Figure 5:
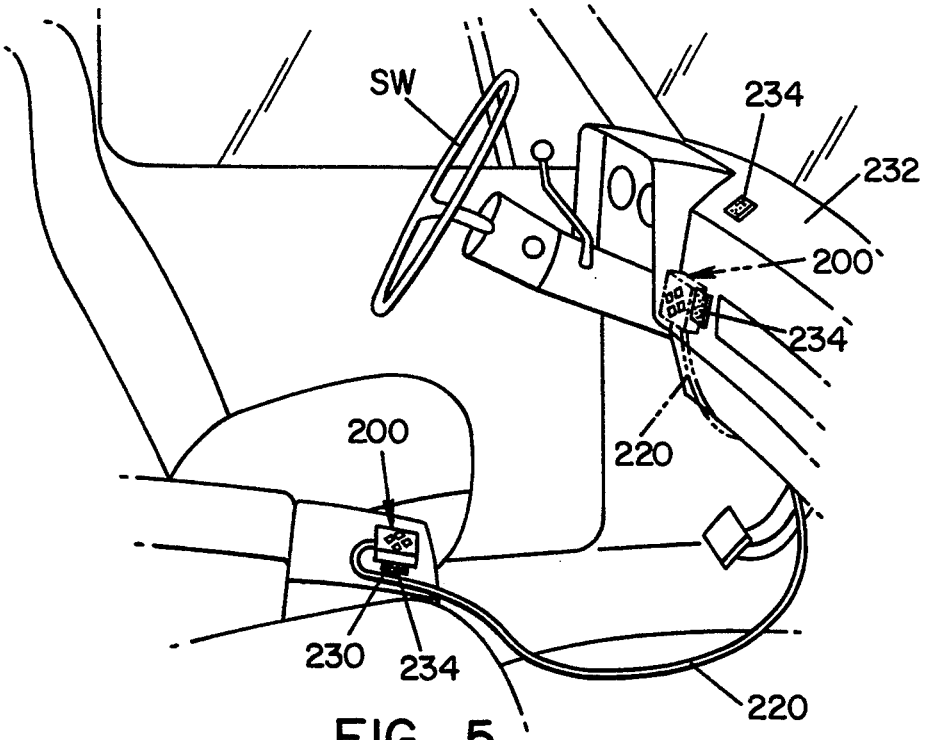
FIG. 5 is a perspective view of a vehicle cab showing the control device mounted in a use position on the vehicle console and showing alternate positions on the dashboard for use or storage of the control device.

In accordance with one aspect of the invention, control device 200 is adapted to be selectively mounted in any one of a plurality of different locations in the cab area of a vehicle having a snowplow unit mounted on the front end thereof. For this purpose, and in accordance with the embodiments illustrated in FIGS. 1–5 of the drawing, back or bottom wall 214 of housing 210 is provided with one component of a two component separable fastener arrangement, and at least one second component of the two component fastener arrangement is located in the vehicle cab so as to best accommodate the desire of a given operator with respect to accessing the control device during a snowplow operation. As shown in FIGS. 1 and 2, wall 214 is provided with one component 230 of the two component fastener arrangement and dashboard 232 in the cab of the vehicle is provided with the second fastener component 234. Preferably, the first and second fastener components 230 and 234 are respectively the hook-and-loop fastener components commonly known as a VELCRO® fastener, each of which is suitably secured in place on wall 214 and dashboard 232 such as by an adhesive. As will be appreciated from FIGS. 4A–4C of the drawing, the second component 234 can be mounted in any one or more of a number of different locations on the dashboard such as on the left or right hand side of steering wheel SW or on an upper or lower portion of the dashboard, whichever suits a given vehicle operator. Preferably, as will be further appreciated from FIGS. 4A–4C, one of the second fastener components 234 is mounted in each of the positions shown on the dashboard, thus to increase the options for a given operator with respect to locating the control device for use during a snowplowing operation, or changing the location during such use, as well as for increasing the versatility with respect to accommodating the needs of a plurality of different persons who may operate the vehicle for snowplowing purposes.

As will be appreciated from FIGS. 4C–4E and FIG. 5, second fastener components 234 can be provided in other locations in the cab area of the vehicle for the foregoing purposes. In this respect, a second fastener component 234 can be suitably mounted on the armrest 236 of a vehicle having such an armrest and/or on the console 238 of a vehicle having such a console and/or on the clothing of the vehicle operator such as pant leg P. As will be apparent from FIGS. 4D, 4E and 5, attaching control device 200 to armrest 236, console 238 or pant leg P requires extension of cord 220 along the floor of the vehicle or in suspension between dashboard 232 and the control device. However, the provision of a second fastener component 234 on dashboard 232 advantageously provides for the cord to be so disposed only during a snowplowing operation. Thus, as shown by the broken line position of control device 200 in FIG. 5, the latter can be attached to dashboard 232 so that cord 220 extends therebeneath when the vehicle is being used other than for snowplowing operations. It will be appreciated from the illustrations in FIGS. 4A–4E and FIG. 5 that there are numerous locations in the cab area of the vehicle which could be provided with a second fastener component 234 in lieu of those shown or to even further increase the selectivity with respect to location of the control device during a snowplowing operation.

Figure 7A:
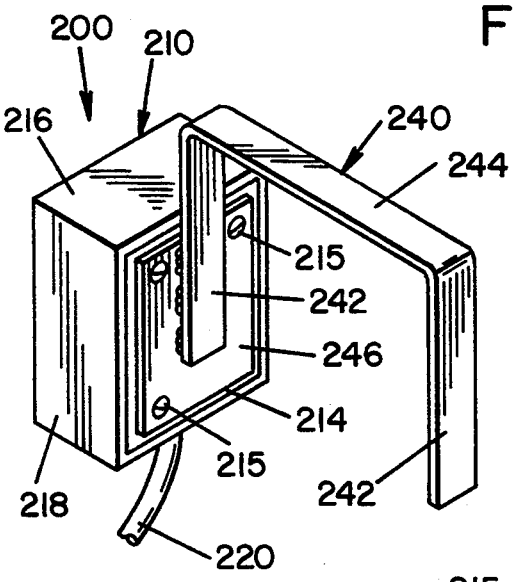
FIG. 7A is a perspective view of the support bracket and control device shown in FIG. 6.
Figure 8:
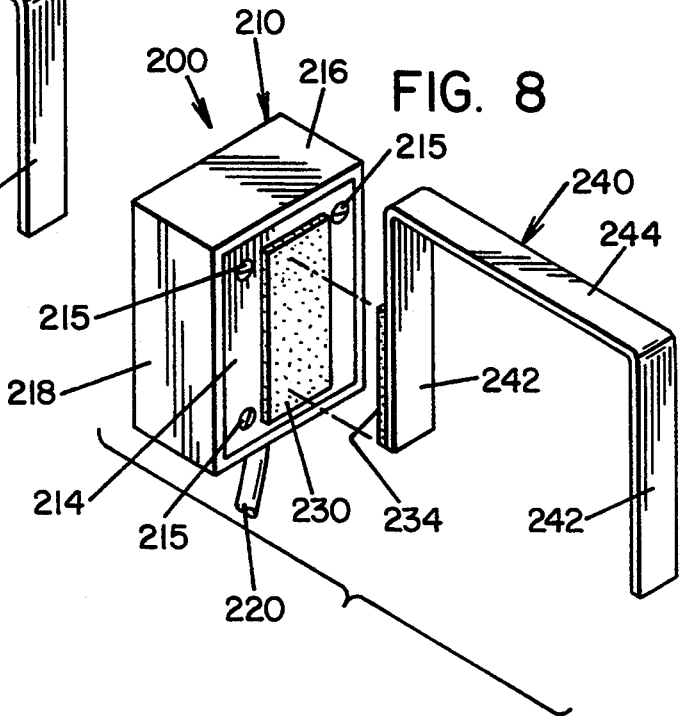
FIG. 8 is a perspective view of the mounting bracket shown in FIG. 7 and illustrating a modification of the mounting arrangement between the control device and bracket.
Figure 6:
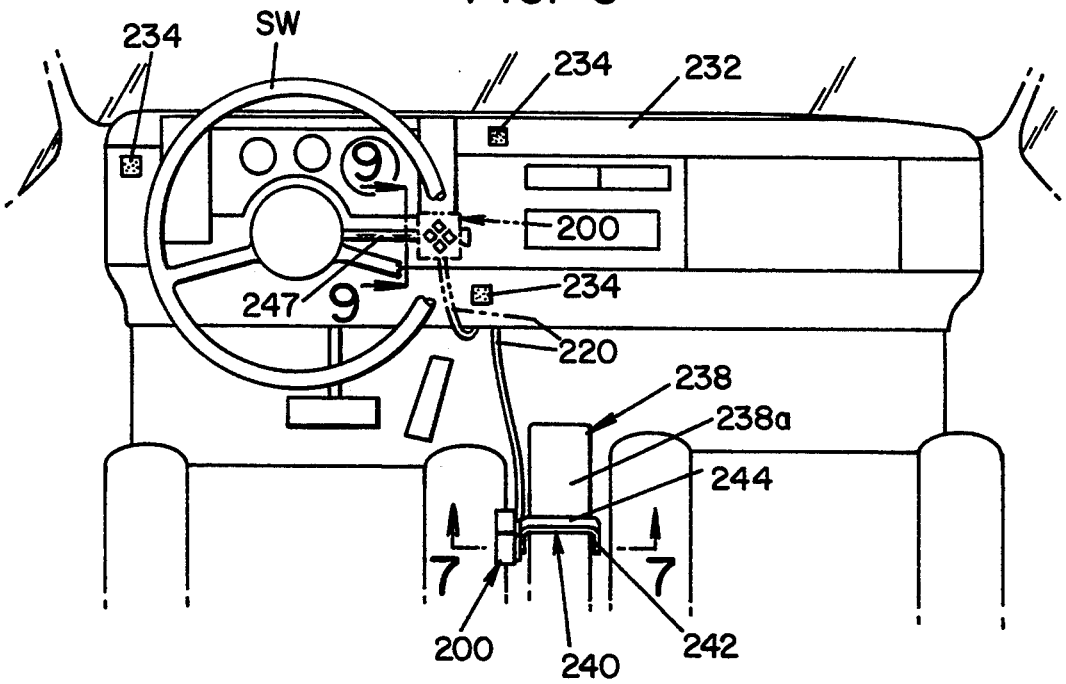
FIG. 6 is an illustration of a portion of a vehicle cab showing mounting locations for the control device on the vehicle gearshift lever and on the console through the use of alternate embodiments of mounting arrangements.
Figure 7:
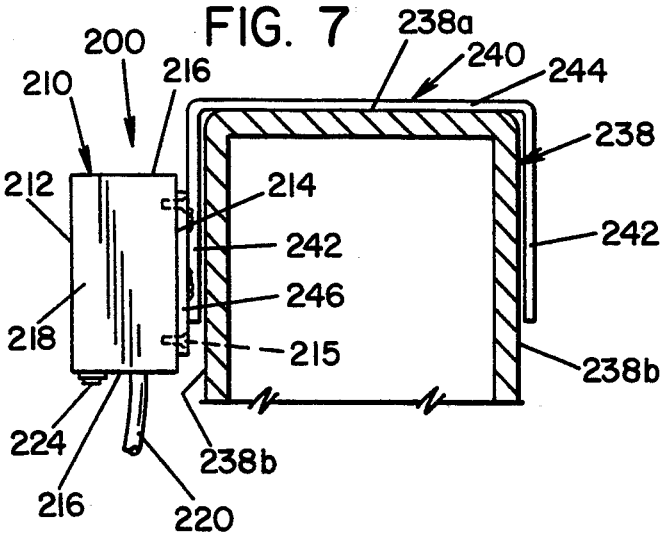
FIG. 7 is a cross-sectional elevation view through the vehicle console taken along line 7—7 in FIG. 6 and illustrating the control device supported thereon by a support bracket.

FIGS. 6–9 illustrate alternative mounting arrangements for the control device which can be used individually or in conjunction with one another or with other mounting arrangements such as those described hereinabove. Referring first to FIGS. 6 and 7 of the drawing, control device 200 is attached to an inverted U-shaped bracket 240 adapted to be removably supported on console 238 in the vehicle cab. More particularly in this respect, console 238 includes a top 238*a* and opposite sides 238*b*, and bracket 240 includes a pair of legs 242 extending downwardly along the opposite sides of the console and a bridging portion 244 between legs 242 and extending across the top of the console to vertically supports the bracket thereon. As best seen in FIG. 7A, one of the legs 242 of bracket 240 has a mounting plate 246 secured thereto, such as by welding, and housing 210 is secured to the mounting plate through the use of threaded fasteners 215 which extend through threaded openings therefor in wall 214. The mounting bracket arrangement advantageously enables the control device to be supported laterally adjacent the vehicle console when, for example, the latter is carpeted or otherwise not suitable for attachment of a fastener component 234 thereto. Preferably, as shown in FIG. 8, the control device is separably mounted on bracket 240 by providing one leg thereof with the second mounting component 234 while providing wall 214 of housing 210 with the first fastener component 230 as described hereinabove in connection with FIGS. 1 and 2 of the drawing. This arrangement advantageously increases selectivity with respect to positioning the control device for use as discussed hereinabove and for securing the control device to a second fastener component on the dashboard during non-snowplowing operation of the vehicle. It will be appreciated, of course, that either mounting plate 246 in FIG. 7, or mounting component 234 in FIG. 8, could be provided on bridging portion 244 of bracket 240 rather than on a leg thereof.

Figure 9:
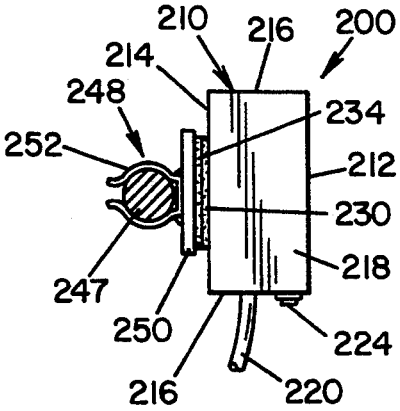
FIG. 9 is a cross-sectional elevation view taken along line 9—9 in FIG. 6 and illustrating a spring clip arrangement for mounting the control device on the vehicle gearshift lever; and, FIG. 10 is a schematic illustration of a vehicle mounted snowplow and the combined hydraulic and electrical system for controlling the position of the snowplow blade through a control device according to the present invention.

Referring now to FIGS. 6 and 9 of the drawing, the control device can be detachably mounted on the gearshifting lever 247 of the vehicle which, in this embodiment, is shown as being associated with the steering column of the vehicle. As best seen in FIG. 9, mounting on gearshift lever 247 is achieved through the use of a spring clip mounting bracket 248 including a base plate 250 to which a generally C-shaped spring clip 252 is secured, such as by welding. The spring clip is adapted to clampingly interengage with gearshift lever 247 so as to preclude pivotal movement of the control device about the gearshift lever as a result of the weight of the device and, preferably, the control device is separably mounted on the spring clip bracket by means of a first fastener component 230 on wall 214 of housing 210, as shown in FIG. 8, and by a second fastener component 234 adhesively bonded or otherwise secured to mounting plate 250. At the same time, however, it will be appreciated that housing 210 of the control device could be directly mounted to plate 250 in the manner shown in FIG. 7A with regard to mounting bracket 240 and mounting plate 246 thereof. The use of fastener components 230 and 234 between the control device and spring clip advantageously enables the control device to be quickly separated from the spring clip and supported at a location on the dashboard during non-snowplowing operation of the vehicle. Alternatively, or if the control device is fastened directly to mounting plate 250, the entire unit including spring clip 248 can be removed from the gearshift lever during non-snowplowing use of the vehicle. It will be appreciated too, that the spring clip arrangement can be used to mount the control device on a gearshift lever associated with the console of the vehicle rather than the steering column.

Figure 10:
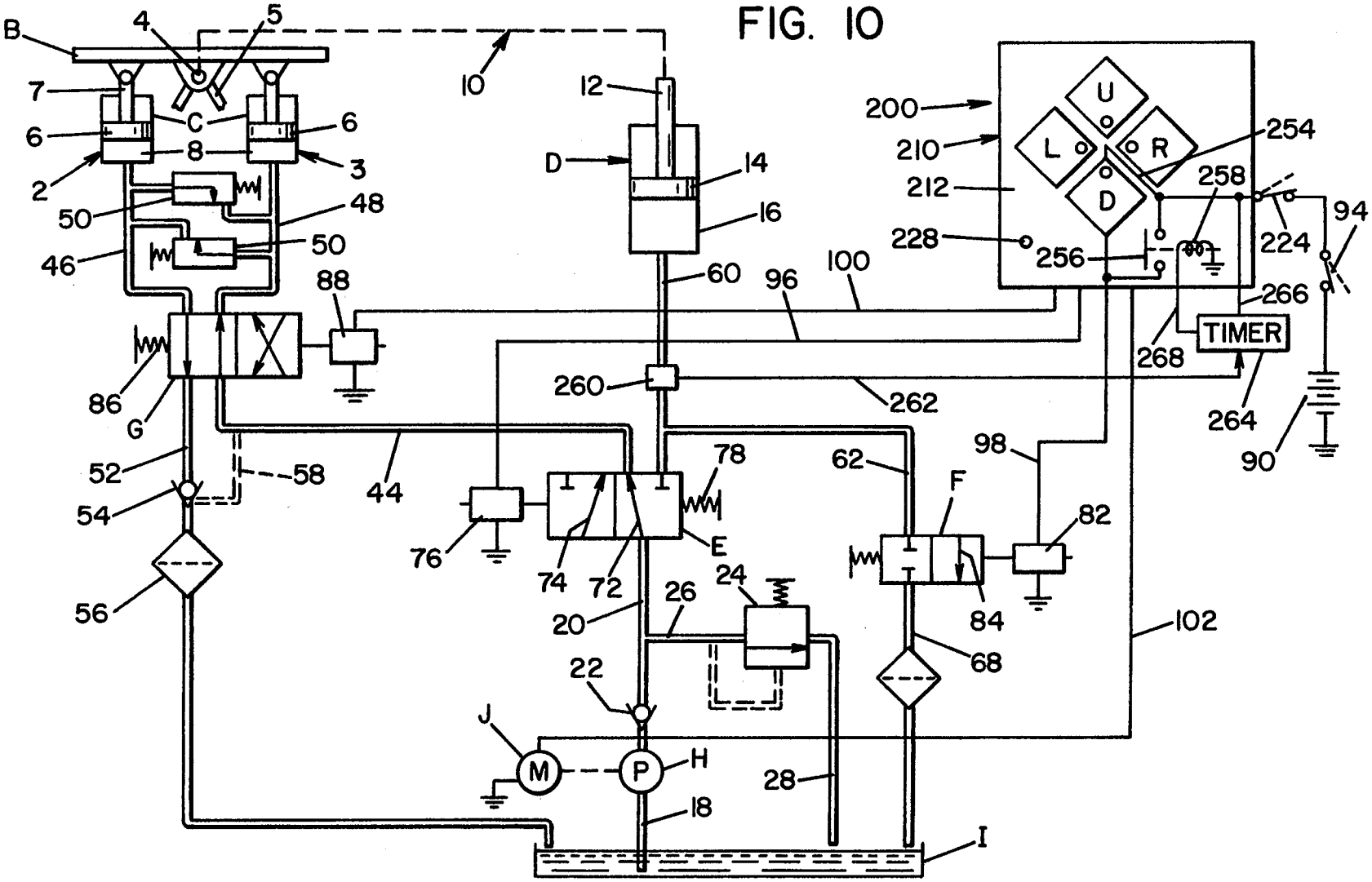

FIG. 10 schematically illustrates the hydraulic and electric circuitry by which the position of snowplow blade B is adjusted or changed through the use of control device 200 and, more particularly, through the depression of the switch actuator pads U, D, L and R of the latter as described hereinabove in conjunction with FIGS. 1—3 of the drawing. FIG. 10 corresponds to FIG. 2 in the Miceli patent incorporated herein by reference and, with the exception of control device 200 and associated circuitry to be described hereinafter, the component parts of the hydraulic and electric circuits are identified by the same numerals and letter designations as in FIG. 2 of the Miceli patent. Further, the hydraulic and electric circuits operate in the same manner as described in the Miceli patent with respect to achieving the up, down, left and right positioning displacements of plow blade B. In this respect, the switch actuator pads U and D of control device 200 provide the same switching function as lever 106 of control device K in the Miceli patent, and the switch actuator pads L and R of control device 200 perform the same switching function as lever 104 of control device K in the Miceli patent. Thus, reference may be had to the latter patent for a detailed description of the operation of the system which accordingly need not be detailed here, except for the blade lowering function which is modified in accordance with the present invention to provide for the plow blade to be in a floating mode after a given time delay following engagement of the blade with ground. In the prior art unit the float mode was accomplished by dropping the blade onto the ground and leaving the control lever in the "down" position. In the present invention, as will become apparent hereinafter, the float condition is achieved after a time delay and the controller provides a visible indication that the time delay period had lapsed and that the blade is in the float mode.

If the operator desires to lower plow blade B, the system operates to achieve this function in the same manner as that described in the Miceli patent. In this respect, the operator will depress switch actuator pad D which will close a circuit through vehicle battery 90, ignition switch 94, kill switch 224, line 254 and line 98 to solenoid 82 so as to shift valve F to the left in FIG. 10 to align passage 84 with lines 62 and 68 connected to cylinder 16 of blade elevating and lowering ram D and hydraulic fluid supply tank I. When valve F opens in the foregoing manner, plow blade B descends under its own weight forcing hydraulic fluid in cylinder 16 to flow through lines 60, 62, 84 and 68 to tank I. When the operator releases actuator pad D, the circuit to solenoid 82 is opened whereupon valve F moves back to the position shown in FIG. 10 to block the flow of fluid to tank I, thus locking plow blade B against further descent. In Miceli, the operator moves the control lever to the neutral or hold position to stop downward movement of the blade. In the present invention, merely releasing the switch stops and holds the blade in a desired lifted position.

In accordance with the present invention, control device 200 is provided with a bypass circuit which is actuated in response to plow blade B engaging ground to maintain solenoid 82 energized independent of the operator's releasing switch actuator pad D, whereby the plow blade remains in a floating mode in which the fluid circuit between cylinder 16 and tank I is open through valve F to eliminate the pressure problem referred to above. In the embodiment illustrated in FIG. 10, the bypass circuit includes a normally open switch 256 between kill switch 224 and line 98 to solenoid 82. Switch 256 is adapted to be closed by a solenoid 258 which is energized in response to a control signal which is generated when plow blade B engages ground. More particularly in this respect, a pressure sensor 260 in line 60 between cylinder 16 and line 62 is adapted to output a control signal through line 262 when the pressure in the system between cylinder 16 and valve F is indicative of engagement of blade B with ground. The control signal is adapted to energize solenoid 258 and, preferably, through a timer 264. Although timer 264 is shown outside housing 210 for purposes of clarity, it will be appreciated that the timer is within the housing. Timer 264 is connected to vehicle battery 90 through line 266 and has an output 268 to solenoid 258 and operates to delay the output to solenoid 258 for a predetermined period of time such as one second, for example, after receiving the control signal through line 262.

In operation, should the operator depress switch actuator pad D to lower blade B, valve F is opened as described above and blade B descends under its own weight. During such descent, there is a slight pressure drop in the hydraulic fluid between cylinder 16 and tank I, but this pressure drop is not sufficient to actuate pressure sensor 260, whereby switch 256 remains open. Should the operator release switch actuator pad D before blade B engages ground, valve F closes as described above and the pressure between cylinder 16 and valve F maintains pressure sensor 260 inactive. However, should the operator continue to depress switch actuator pad D until blade B engages ground, the blade B is now supported by ground whereby there is a significant drop in the fluid pressure between cylinder 16 and valve F. Pressure sensor 260 responds to this lower pressure to output the control signal through line 262 to timer 264 which, after the predetermined time delay, actuates solenoid 258 through line 268 to close switch 256. Solenoid 82 is then actuated to maintain valve F open for passage 84 therethrough to communicate with lines 62 and 68, whereby blade B is placed in the floating mode described hereinabove. When switch 256 closes, indicator light 228 is illuminated to visually indicate to the operator that the blade is in the floating mode.

Pressure sensor 260 will continue to output a control signal to maintain switch 256 closed until such time as blade B is elevated from ground by introducing fluid under pressure into cylinder 16 behind piston 14, whereby the pressure between cylinder 16 and valve F again increases to a level which deactuates pressure sensor 260. When the control signal is no longer sent to timer 264 the output thereof to solenoid 258 is interrupted whereby switch 256 opens to de-energize solenoid 82 and close valve F. Timer 264 is also reset when the control signal is terminated. As will be further appreciated from FIG. 10, opening of ignition switch 94 disconnects the electric circuit of the snowplow unit from vehicle battery 90 even if the operator inadvertently leaves kill switch 224 in its closed position. On the other hand, when the vehicle is being operated for other than snowplowing purposes and ignition switch 94 is closed, kill switch 224 advantageously provides for disconnecting the electric circuit of the snowplow unit from the vehicle battery. This advantageously avoids any unintentional or accidental actuation of the snowplow unit during non-snowplowing use of the vehicle.

While considerable emphasis has been placed herein on the preferred embodiments illustrated and described with respect to the present invention, it will be appreciated that many changes can be made in these embodiments and that other embodiments can be made without departing from the principles of the invention. In this respect, for example, while it is preferred to use the loop and hook fastener components of a VELCRO® fastener to provide the readily separable two fastener component arrangement for mounting the control device in the vehicle cab, it will be appreciated that such a two fastener component arrangement can be provided, for example, by slidably interengaging bracket members or by a magnet arrangement. Likewise, it will be appreciated that other bypass arrangements can be provided for maintaining valve F open to achieve operation of the plow blade in a floating mode, and that an arrangement other than the fluid pressure sensing herein disclosed can be employed to produce a control signal indicative of blade engagement with ground. These and other modifications of the embodiments disclosed herein as well as other embodiments of the invention will be suggested or obvious to those skilled in the art, whereby it is to be distinctly understood that the foregoing descriptive matter is to be interpreted merely as illustrative of the invention and not as a limitation.

Having thus described the invention it is claimed:

1. A control device for controlling component parts of a system for positioning a snowplow blade attached to a motor vehicle having a cab for operation of the vehicle, said device being in said cab and comprising housing means, manually operable means supported on said housing means for controlling said component parts of said system, line means extending from said housing means for connecting said manually operable means with said component parts, mounting means on said housing means, means in said cab cooperable with said mounting means to removably support said device in said cab, said mounting means including bracket means and said vehicle including console means in said cab, said console means providing said means in said cab cooperable with said mounting means, said bracket means being removably supported on said console means, and said console means including a top and opposite sides and said bracket means is U-shaped and includes spaced apart legs and a bridging portion therebetween, said bridging portion extending across said top and said legs extending along said opposite sides.

2. A control device according to claim 1, and fastening means fastening said housing means to one of said legs and bridging portion of said bracket means.

3. A control device according to claim 2, wherein said fastening means includes first fastening means on said housing means and second fastening means on said one leg of said bracket means, said first and second fastening means including means releasably interengaging with one another to releasably support said device on said bracket means.

4. A control device according to claim 3, wherein said means releasably interengaging with one another are hook and pad fastener components.

5. A control device according to claim 1, wherein said vehicle includes gearshift lever means in said cab providing said means cooperable with said mounting means.

6. A control device according to claim 5, wherein said means releasably interengaging said device with said lever means also includes mounting bracket means, said hook and loop fastener releasably interengaging said mounting bracket means to said housing means.

7. A control device according to claim 6, wherein said bracket means includes means releasably interengaging with said lever means.

8. A control device for controlling component parts of a system for positioning a snowplow blade attached to a motor vehicle having a cab for operation of the vehicle, said device being in said cab and comprising housing means, manually operable means supported on said housing means for controlling said component parts of said system, line means extending from said housing means for connecting said manually operable means with said component parts, mounting means on said housing means, means in said cab cooperable with said mounting means to removably support said device in said cab, said vehicle including gearshift lever means in said cab providing said means cooperable with said mounting means, said mounting means including means releasably interengaging said device with said lever means, said means releasably interengaging said device with said lever means includes mounting bracket means, said mounting bracket means including spring clip means engaging said lever means, and fastening means fastening said spring clip means to said housing means; said fastening means include first fastening means on said housing means and second fastening means on said spring clip means, said first and second fastening means including means releasably interconnecting with one another to releasably support said device on said spring clip means.

9. A control device for controlling component parts of a system for positioning a snowplow blade attached to a motor vehicle having a cab for operation of the vehicle, said device being in said cab and comprising housing means, manually operable means supported on said housing means for controlling said component parts of said system, line means extending from said housing means for connecting slid manually operable means with said component parts, mounting means on said housing means, means in said cab cooperable with said mounting means to removably support said device in said cab, said plow blade is lifted hydraulically and lowered by gravity, said system comprising a cylinder secured to said vehicle, ram means in said cylinder and connected to said blade for raising said blade when pressurized liquid is introduced into said cylinder to move said ram means from said cylinder, a supply of liquid, pump means having an inlet communicated with said supply and an outlet for pressurized liquid, means for driving said pump means, a first conduit connecting said outlet and said cylinder, first valve means in said first conduit and having a first position connecting said outlet with said cylinder and a second position blocking communication of said outlet with said cylinder, a second conduit communicating said cylinder with said supply, second valve means in said second conduit and having a first position communicating said supply with said cylinder and a second position blocking communication between said cylinder and said supply, first electrical solenoid means for selectively moving said first valve means between said first and second positions thereof, second electrical solenoid means for selectively moving said second valve means between said first and second positions thereof, said manually operable means of said control device comprising first and second manually operated control elements, said first manually operated control element causing said first electrical solenoid means to shift said first valve means into said first position thereof, whereby operation of said pump means causes movement of said ram from said cylinder and raising of said blade, said second manually operated control element causing said second electrical solenoid means to shift said second valve means into said first position thereof, whereby the weight of said blade can force said ram into said first cylinder and allow lowering of said blade, said blade being lowerable to engage the ground beneath said vehicle, said control device including means to sense engagement of said blade with ground during lowering thereof, and control means in said housing means responsive to said sensed engagement to maintain said second valve means in said first position thereof independent of said second manually operated control element.

10. The improvement according to claim 9, wherein said third control means includes means to delay response to said sensed engagement.

11. The improvement according to claim 9, wherein said control means includes means for causing said second electrical solenoid means to maintain said second valve means in said first position thereof.

12. The improvement according to claim 9, wherein said means to sense engagement is fluid pressure sensing means in said first conduit between said first valve means and said cylinder.

13. The improvement according to claim 12, wherein said control means includes means for causing said second electrical solenoid means to maintain said second valve means in said first position thereof.

14. The improvement according to claim 13, wherein said control means includes means to delay response to said sensed engagement.

15. The improvement according to claim 13, wherein said means for causing said second solenoid means to maintain said second valve means in said first position thereof includes switch means responsive to said fluid pressure sensing means.

16. The improvement according to claim 15, wherein fluid in said cylinder has a given pressure when said blade engages ground and said fluid pressure sensing means includes means for producing a control signal indicative of said given pressure, and said control means includes means responsive to said control signal to actuate said switch means.

17. The improvement according to claim 16, wherein said means responsive to said control signal includes timer means to delay actuation of said switch means for a predetermined period of time after receiving said control signal.

* * * * *